US006023948A

United States Patent [19]

Schmoll et al.

[11] Patent Number: 6,023,948

[45] Date of Patent: Feb. 15, 2000

[54] KNITTING TOOL, SUCH AS A SELECTOR SINKER OR A NEEDLE, HAVING AN INTEGRAL CONTROL SPRING

[75] Inventors: Wolfgang Schmoll, Haigerloch-Owingen; Klaus Ruoff, Albstadt; Thomas Schmid, Balingen, all of Germany

[73] Assignee: Groz Beckert KG, Albstadt, Germany

[21] Appl. No.: 09/078,478

[22] Filed: May 14, 1998

[30] Foreign Application Priority Data

May 14, 1997 [DE] Germany ..... 197 20 169

[51] Int. Cl.[7] ..... D04B 35/02

[52] U.S. Cl. ..... 66/123; 66/116

[58] Field of Search ..... 66/104, 107, 116, 66/119, 120, 121, 123, 124

[56] References Cited

U.S. PATENT DOCUMENTS

| | | | |
|---|---|---|---|
| 329,906 | 11/1885 | Huse | 66/123 |
| 601,281 | 3/1898 | Salisbury | 66/123 |
| 3,643,472 | 2/1972 | Apprich | 66/115 |
| 4,548,056 | 10/1985 | Schuler | 66/116 |
| 5,076,074 | 12/1991 | Halamoda et al. | 66/124 |
| 5,806,347 | 9/1998 | Ando' | 66/116 |

FOREIGN PATENT DOCUMENTS

| | | |
|---|---|---|
| 2 245 842 | 3/1974 | Germany . |
| 27 55 471 | 6/1978 | Germany . |
| 29 18 841 | 11/1990 | Germany . |
| 195 41 407 | 5/1997 | Germany . |

*Primary Examiner*—John J. Calvert
*Assistant Examiner*—Larry D. Worrell, Jr.
*Attorney, Agent, or Firm*—Venable; Gabor J. Kelemen

[57] ABSTRACT

A knitting tool includes a flat shank having opposite first and second narrow sides and an elongated, narrow control spring forming an integral, one-piece part with the shank and projecting therefrom. The control spring has a first, free end and an opposite second end. The second end is directly formed on the shank and constitutes a continuation of the first narrow shank side. The knitting tool further has an elongated bay bounded by the control spring and the first narrow shank side. The bay has an open end at the first, free end of the control spring and a closed end at the second end of the control spring.

7 Claims, 1 Drawing Sheet

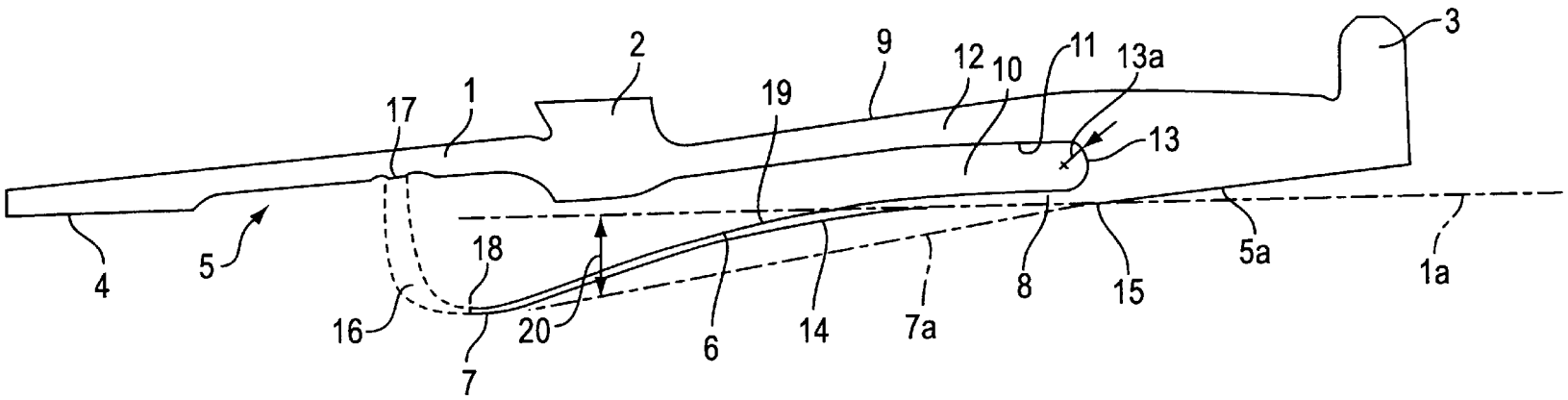
3
1a
5a
13a
13
15
11
8
10
12
7a
9
14
19
6
2
20
18
7
1
17
16
5
4

KNITTING TOOL, SUCH AS A SELECTOR SINKER OR A NEEDLE, HAVING AN INTEGRAL CONTROL SPRING

CROSS REFERENCE TO RELATED APPLICATION

This application claims the priority of German Application No. 197 20 169.5 filed May 14, 1997, which is incorporated herein by reference.

BACKGROUND OF THE INVENTION

This invention relates to a knitting tool, for example, a selector sinker or a needle for a knitting machine and is of the type which has a flat shank and further has an elongated, narrow control spring which projects from the shank in the region of a narrow side thereof and which is secured to the shank at one spring end.

German Offenlegungsschrift (application published without examination) 15 85 211 describes a circular knitting machine having an electronic needle selecting system in which the needles are controlled by plungers formed as selector sinkers which, according to the knit pattern, may be pivoted radially back and forth between an operative and an idle position to cause them to engage or disengage a cam track. Each selector sinker carries in the region of its narrow side a projecting control spring formed as a small spring bar which, at one end, is anchored in a shank portion of the selector sinker. The control spring, in the region of its free end, engages a countersupport on the needle cylinder and functions as a resetting spring for the electromagnetically controlled selector sinkers.

For anchoring the control spring in the shank part of the selector sinker, one end portion of the control spring is bent to have two legs arranged as a hairpin, and one leg is pressed into an outwardly flaring, slot-like aperture of the shank portion. Since, with such a securement, the control spring is merely clamped with its end portion into the slot-like recess of the shank part of the selector sinker and thus is only frictionally held under bias, there is a risk that in the course of an extended service, because of the high dynamic loads on the control spring, its end portion slightly creeps outwardly of the slot-like recess of the shank part of the selector sinker. As a result, undesired friction forces are generated in the associated guide channel for the needle and the selector sinker in the needle cylinder. Furthermore, uncontrolled dimensional changes in the position of the control springs with respect to the selector sinkers may appear which also adversely affect the operation of the knitting machine.

Basically the same considerations apply to another known selector sinker disclosed in U.S. Pat. No. 3,643,472. The selector sinker illustrated in FIG. 10 of that patent has a control spring whose end portion is clamped into a recess having parallel sides extending approximately at right angles to the longitudinal axis of the sinker. The control spring is secured against axial movements by a rectangularly bent end part. For this purpose the sinker must be provided with an essentially L-shaped, slot-like recess which involves manufacturing difficulties.

Further, German Offenlegungsschrift 23 27 585 describes a circular knitting machine operating with needles which carry, at their shank part, a unilaterally anchored control spring serving the magnetic needle selecting system. In this arrangement the control spring is, with its end portion, fitted into a parallel-sided slot in the needle shank portion and is immobilized therein by wedging. The control spring is made of a thin spring steel plate or of a cross-sectionally round or slightly flat-rolled spring steel member to exhibit flattened portions. While a form-fitting connection between the end of the control spring and the needle shank portion may be obtained, the individual, spaced embossed locations in the region of the side walls of the slot do not ensure an accurate, lateral orientation of the control spring relative to the needle shank. Since the control spring is of a hard material and therefore is not deformed during upsetting (wedging), risks prevail that due to the earlier-mentioned high dynamic loads imparted on the control spring, its end portion frees itself slightly from the upset parts after a certain period of time. As an undesired result, the entire control spring could rotate—to a limited extent—in the anchoring slot. It is a further risk that the slot is widened by the transverse forces which are generated during the upsetting (wedging) operation and thus the height dimension of the shank changes in an uncontrollable manner.

A significant improvement of the anchoring of the control spring in the shank of a knitting tool, such as a selector sinker or a needle for a knitting machine is achieved by the construction described in U.S. Pat. No. 5,076,074. In the shank portion of the knitting tool described therein a depression is provided which adjoins a slot-like aperture open towards the narrow side of the shank. The width of the depression, measured transversely to the longitudinal dimension of the aperture, is at least at some locations greater than the width of the aperture. The control spring has at its end portion an anchoring section which is enlarged corresponding to the width of the depression and whose thickness is less than or is equal to the depth of the depression. The control spring is at least on one side laterally guided in the aperture and is fitted into the depression with its anchoring section. The position of the aperture and the depression define an exact orientation of the control spring in a respective predetermined position thereof, and the enlarged anchoring section prevents an undesired turning of the control spring. The depression ensures an unequivocal firm association of the control spring with the shank portion of the knitting tool, providing for a possibility of a very accurate, positionally correct installation of the control spring.

All of the above-described knitting tools are of a two-part construction; that is, the knitting tool proper on the one hand and the control spring, on the other hand, are manufactured as separate parts and are subsequently form-fittingly secured to one another and, if required, additionally immobilized. Such a two-part configuration of the knitting tool is relatively expensive. Furthermore, the recess or the depression in which the control spring is anchored is, as viewed transversely to the longitudinal dimension of the needle shank, necessarily spaced from the narrow side of the shank in the vicinity of the control spring to ensure that in the region of the recess or depression sufficient shank material remains for a secure anchoring of the inserted part of the control spring.

Recently sinkers have been developed which, together with their control spring, are made of a single piece and are hardened and ground. Corresponding to the earlier-noted two-part selector sinkers, in the single-piece construction the end portion of the control spring formed at the shank and connecting the control spring with the shank is, as viewed transversely to the longitudinal direction of the shank, at a significant distance from the narrow shank side associated with the control spring, at a location which corresponds approximately to the mid height of the shank. Between the control spring and the shaft region at the narrow shaft side facing the control spring, a narrow, slot-like space is provided which opens towards the free end of the control spring. The slot-like space permits the control spring the free mobility required for performing its function during operation. Also, a further slot-like space is provided which opens towards the oppositely situated narrow side of the shank in the zone of the end portion of the control spring formed on the shank. Such a further slot-like space is shorter in the longitudinal shank direction and is bounded by an upstanding finger or a pin-like extension. Such a rigid attachment serves as a support location on which lies the selector sinker inserted into a guide channel of the knitting machine and which contains the axis about which the selector sinker pivots under the effect of the associated cams during operation.

A selector sinker of the above-outlined structure involves the risk that after a longer service period during which high dynamic loads are generated, the control spring may break due to material fatigue, particularly in the region of its end portion formed on the shank.

SUMMARY OF THE INVENTION

It is an object of the invention to provide an improved knitting tool of the above-outlined type which has a control spring formed on the tool shaft and which may be manufactured without prohibitive expense, which has a long service life and whose control spring has excellent resilient properties.

This object and others to become apparent as the specification progresses, are accomplished by the invention, according to which, briefly stated, the knitting tool includes a flat shank having opposite first and second narrow sides and an elongated, narrow control spring forming an integral, one-piece part with the shank and projecting therefrom. The control spring has a first, free end and an opposite second end. The second end is directly formed on the shank and constitutes a continuation of the first narrow shank side. The knitting tool further has an elongated bay bounded by the control spring and the first narrow shank side. The bay has an open end at the first, free end of the control spring and a closed end at the second end of the control spring.

As a result of the construction according to the invention, at given height dimensions of the shank the width of the bay measured perpendicularly to the longitudinal direction of the shank from the inner edge of the control spring to the remaining, web-like portion of the shank may be relatively large without adversely affecting the operation of the knitting tool or the control spring. Such a substantial width of the bay permits, subsequent to the stamping step, a machining of at least the free end region of the upper spring face oriented towards the remaining shank portion for reducing its surface roughness. This is an advantage because it has been found that a significant lengthening of the service life of the integral control spring may be achieved by removing from the control spring surface stamping scuffs, burrs and other irregularities resulting from the manufacturing process. Such scuffs and the like, if present, cause a certain notching effect which has been recognized as the cause for a premature breakage of the control spring, particularly at the dynamically highly stressed transitional region of its end portion to the tool shank.

Further, the large free space made possible by the invention between the control spring and the remaining portion of the tool shank leads to a significant reduction of the inertia of the knitting tool. As a result, upon motion of the knitting tool the inertia forces generated during operation are reduced and thus heat generation and the wear on the cam parts which move the knitting tool are decreased as well.

Further, in cases where it is of significance for a satisfactory operation of the knitting tool, the configuration of the control spring according to the invention provides for a significantly greater spring mobility than in most known knitting tools having a control spring.

It has been found in practice to be expedient to so dimension the bay between the control spring and the remaining shank portion oriented theretoward, that its width measured approximately perpendicularly to the longitudinal dimension of the tool shank has, at least in the region of the end portion of the control spring, a ratio of approximately at least 2–4:1 to the height of the control spring in that region.

If the knitting tool according to the invention is a selector sinker, the shank support area which contains the pivot axis is advantageously situated on the bottom of the associated guide groove of the knitting machine, at the associated narrow side of the shank, in the vicinity of the end portion of the control spring. Stated differently, the shank support area which contains the pivot axis is situated in the region of the terminal bay edge situated above the control spring.

While in the conventional construction of a selector sinker having a formed-on control spring, the slot-like space between the control spring and the remaining facing shank portion is so narrow that a subsequent machining of the upper surface of the control spring adjoining such a space is practically not possible without a substantial technological input, in the knitting tool according to the invention, the required reduction of the surface roughness in such a region may be achieved in a simple manner, for example, by scouring the knitting tools in a scouring drum. In individual cases, if required, a subsequent polishing may also be performed without the need of using expensive, very small tools.

Knitting tools within the meaning of the invention encompass needles, sinkers, plungers and the like; in short, any component which serves for the loop formation or cooperates in such an operation and which needs a control spring for its functioning.

BRIEF DESCRIPTION OF THE DRAWING

The sole FIGURE is a side elevational view of a preferred embodiment of the invention.

DESCRIPTION OF THE PREFERRED EMBODIMENT

The illustrated knitting tool is a selector sinker for a circular knitting machine operating with an electromagnetic needle selecting system, such as described, for example, in German Patent No. 3,712,673. In addition to elements which are of no interest as concerns the present description, the selector sinker has a shank 1 on which an ejecting butt 2 and a control butt 3 are positioned. At the end of the shank 1 opposite from the control butt 3 a precision-machined (polished or ground) planar armature face 4 is provided which cooperates with a selector magnet, as described in the above-noted German Patent No. 3,712,673. The armature face 4 is provided on the shank 1 at the narrow side (underside) 5 which is opposite from the ejector butt 2 and the control butt 3.

In the region of the narrow side 5 a narrow, elongated control spring 6 is provided which projects from the shank 1 and which is an integral part thereof. The thickness of the control spring 6 measured in a direction perpendicular to the plane of the drawing FIGURE accordingly corresponds to the thickness of the shank 1 stamped of sheet metal and further, the control spring 6 lies in the plane of the shank 1. In individual cases, taking into consideration the spring characteristics of the control spring to be obtained or for other reasons it may be expedient to reduce the thickness of the control spring 6 relative to that of the shank 1. Such a reduction may be effected, for example, by a pressing or grinding step subsequent to the stamping process. The control spring 6 has a free end portion 7 which is bent slightly in a spoon-like manner and an opposite end portion 8 by means of which the control spring 6 is formed on the shank 1. As shown in the FIGURE, the control spring 6 is slightly tapering from the end portion 8 toward the free end portion 7, and has a slightly concave configuration as viewed from below. Between the control spring 6 and the facing narrow side 9 of the shank 1 an edgewise open recess or bay 10 is provided in the shank 1. The bay 10 forms a space which is open at the free end 7 of the control spring 6. In the region of the end portion 8 of the control spring 6 the bay 10 is bounded by the control spring 6 and the oppositely located edge 11 of the remaining portion 12 of the shank 1. The closed end of the bay 10 is defined by a circularly extending edge 13 which has smooth transitions into the adjoining edge zones of the control spring 6 and the shank portion 12. The radius 13*a* of the circular edge 13 is greater than or identical to the height of the end portion 8 of the control spring 6 in this region; in either case a rounded portion at that location is provided.

As seen in the FIGURE, the underside 14 of the control spring 6 directly adjoins, and thus forms a continuation of, the narrow side zone 5*a* of the shank 1 opposite the control butt 3 in the zone of the spring end portion 8. Stated differently, the control spring 6 is, with its end portion 8, formed on the shank 1, while directly adjoining the narrow shank side 5*a*. Such an arrangement is in contrast to those known constructions in which the end portion 8 of the control spring is, with respect to the narrow shank side 5*a*, offset in the direction of the other narrow side 9 of the shank 1.

In the transitional region between the portion 5*a* of the narrow side 5 of the shank 1 and the end portion 8 of the control spring 6 a transverse crest edge 15 is provided on the shank 1. The crest edge 15 is situated approximately to underneath the circular terminal edge 13 of the bay 10 and forms a fulcrum where the selector sinker is supported on the bottom of a non-illustrated guide groove of the needle cylinder of the knitting machine. Under the effect of the control cams the shank 1 is, during operation, pivoted about the crest edge 15 in such a manner that, dependent upon the knit pattern, the armature face 4 either lies against the pole face of the non-illustrated selector magnet and is held firmly thereon by magnetic forces or is held at a distance from such pole face by the control spring 6. In principle, the crest edge 15 may also lie in the region of the end part 8 of the control spring 6 or, dependent upon the particular embodiment, it may also be shifted further towards the control butt 3 as compared to the showing in the FIGURE.

In making the described selector sinker according to the invention, first a blank corresponding to the outline of the selector sinker shown in the FIGURE is stamped from a steel ribbon. In that stage of manufacture the control spring 6 is extended by a web 16 shown in phantom lines. One end 17 of the web 16 is formed on the shank 1, while its other end 18 is formed on the end portion 7 of the control spring 6. Thus, in the stamped blank the bay 10 is therefore an entirely closed space provided in the shank 1 and bounded by the control spring 6, the web 16 as well as the adjoining parts of the shank 1. After stamping, the blank is hardened by submitting it, at least in zones, to a suitable heat treatment. During such a hardening, the portion which eventually forms the control spring 6 obtains spring-elastic properties. In the alternative the blank may be made directly from the hard material in which case a subsequent hardening treatment is dispensed with.

Subsequently, at least the portion which forms the spring tongue 6, particularly its underside 14 and upper side 19, is exposed to a surface treatment to obtain a smooth outer surface of diminished roughness and to remove burrs, scuffs, notches and other irregularities stemming from the stamping process. It has been found that such a surface treatment may be performed in a simple manner by scouring in a scouring drum. Such a simple surface treatment is feasible because, on the one hand, the control spring 6 is immobilized relative to the shank 1 by means of the web 16 and, on the other hand, the closed bay 10 in the shank 1 has a maximum width so that the scouring material may also reach particularly the upper spring side 19 oriented towards the facing shank portion 12.

Dependent upon the dimensions of the knitting tool and the requirements concerning the surface quality of the control spring 6, it is in principle feasible to fine-finish its upper surface in another manner, for example, by means of a small-diameter grinding disk. It is of importance in this connection that the improvement in the surface quality takes places above all in the region of the end portion 8 and in the transitional region between the end portion 8 and the shank 1, that is, at the rounded part 13.

Subsequent to the above-outlined surface treatment the web 16 is broken off or stamped out; for this purpose weakening notches may be provided in the web 16 at its ends 17 and 18.

The width of the bay 10 measured perpendicularly to the length dimension of the shank 1 depends from structural conditions of the knitting tool. As a rule, such a dimension has a ratio of approximately 2–4:1 to the height of the control spring 6 in its terminal zone 8. Under "height" of the control spring 6 there is meant its dimension measured in the plane of the drawing, at least approximately perpendicularly to the spring length.

In the illustrated embodiment the control spring 6 extends obliquely downwardly from the narrow side zone 5*a* of the shank 1. The underside of the free end portion 7 of the control spring 6 lies on a tangent 7*a* which passes through the crest edge 15 and which forms an angle of approximately 10° with a straight line 1*a* passing through the crest edge 15 and extending parallel to the shank axis.

It will be understood that the above description of the present invention is susceptible to various modifications, changes and adaptations, and the same are intended to be comprehended within the meaning and range of equivalents of the appended claims.

What is claimed is:

1. A knitting tool comprising (a) a flat shank stamped from a steel ribbon; said shank having opposite first and second narrow sides and a longitudinal axis;

(b) at least one butt being integral with said shank and being formed on said second narrow side thereof;

(c) an elongated, narrow control spring forming an integral, one-piece part with said shank and projecting therefrom in a region of said first narrow side thereof opposite to said at least one butt; said control spring having a first, free end and an opposite second end; said second end of said control spring being directly formed on said shank and constituting a continuation of said first narrow side; and (d) an elongated bay provided in said shank and being bordered by said control spring; said bay having an open end at said first, free end of said control spring and a closed end at said second end of said control spring.

2. The knitting tool as defined in claim 1, wherein a width of said bay in a region of said second end of said control spring has a ratio of approximately 2–4:1 to a height of said control spring in said region; said width and said height being measured approximately perpendicularly to said longitudinal axis.

3. The knitting tool as defined in claim 1, wherein said control spring has a treated surface in a region of said second end for reducing surface roughness.

4. The knitting tool as defined in claim 1, further comprising a fulcrum location provided on said first narrow side of said shank in a region of said closed end of said bay.

5. The knitting tool as defined in claim 4, wherein said fulcrum location is a crest edge extending perpendicularly to said longitudinal axis.

6. The knitting tool as defined in claim 1, wherein said closed end of said of said bay is rounded and has a radius of curvature being at least as long as a height of said control spring in a region of said second end thereof; said height being measured approximately perpendicularly to said longitudinal axis.

7. A knitting tool comprising (a) a flat shank stamped from a steel ribbon; said shank having opposite first and second shank ends, opposite first and second narrow sides and a longitudinal axis;

(b) at least one butt being integral with the shank and being formed on said second narrow side thereof;

(c) an elongated, narrow control spring forming an integral, one-piece part with said shank and projecting therefrom toward said second shank end in a region of said first narrow side thereof opposite to said at least one butt; said control spring having a first, free end and an opposite second end; said second end of said control spring being directly formed on said shank; said control spring having an underside and an upper side; said underside of said control spring constituting a continuation of said first narrow side of said shank; and (c) an elongated bay provided in said shank and being bounded by said upper side of said control spring; said bay having an open end at said first, free end of said control spring and a closed end at said second end of said control spring; said open end of said bay being closer to said second end of said shank than said closed end of said bay; said closed end of said bay being spaced from said first end of said shank in a direction generally parallel to said shank axis whereby a length portion of said shank being defined between said closed end of said bay and said first end of said shank.

* * * * *